US005321375A

United States Patent [19]

Corman

[11] Patent Number: 5,321,375

[45] Date of Patent: Jun. 14, 1994

[54] RF CROSSOVER NETWORK

[75] Inventor: David W. Corman, Chandler, Ariz.

[73] Assignee: Motorola, Inc., Schaumburg, Ill.

[21] Appl. No.: 983,196

[22] Filed: Nov. 30, 1992

[51] Int. Cl.[5] ..... H01P 5/00

[52] U.S. Cl. ..... 333/246; 333/238

[58] Field of Search ..... 333/1, 238, 246

[56] References Cited

U.S. PATENT DOCUMENTS

| | | | |
|---|---|---|---|
| 3,104,363 | 9/1963 | Butler | 333/246 |
| 4,023,125 | 5/1977 | Wolfe | 333/238 |
| 4,334,202 | 6/1982 | Cornish et al. | 333/246 X |
| 4,675,620 | 6/1987 | Fullerton | 333/1 |

FOREIGN PATENT DOCUMENTS

| | | | |
|---|---|---|---|
| 160201 | 6/1989 | Japan | 333/246 |

OTHER PUBLICATIONS

An article entitled "Characterization of Strip Line Crossing by Transverse Resonance Analysis" by T. Uwano et al., *IEEE Transactions on Microwave Theory and Techniques*, vol. MTT-35, No. 12, Dec. 1987, pp. 1369-1376.

An articled entitled "Electromagnetic Response of Two Crossing, Infinitely Long, Thin Wires" by J. L. Young et al., *IEEE Transactions on Antennas and Propagation*, vol. 39, No. 6, Jun. 1991, pp. 732-739.

*Primary Examiner*—Paul Gensler
*Attorney, Agent, or Firm*—Jeffrey D. Nehr

[57] ABSTRACT

A RF crossover network includes a RF line, a DC/control line capacitively coupled to the RF line at a crossover of the RF line, and RF terminations coupled to the DC/control line. A RF signal carried on the RF line is unperturbed by the presence of a DC/control signal on the DC/control line. The RF line is mounted on a first dielectric layer including a ground plane. A second dielectric layer includes first and second surfaces with the DC/control line mounted on the first surface of the second dielectric layer and the second surface of the second dielectric layer positioned adjacent to the RF line. RF terminations are used on opposite ends of a half wave resonator. The RF terminations can comprise shunt capacitors, metal-insulator-metal (MIM) capacitors in a monolithic microwave integrated circuit (MMIC) embodiment, or open-circuited quarter wavelength transmission lines.

7 Claims, 3 Drawing Sheets

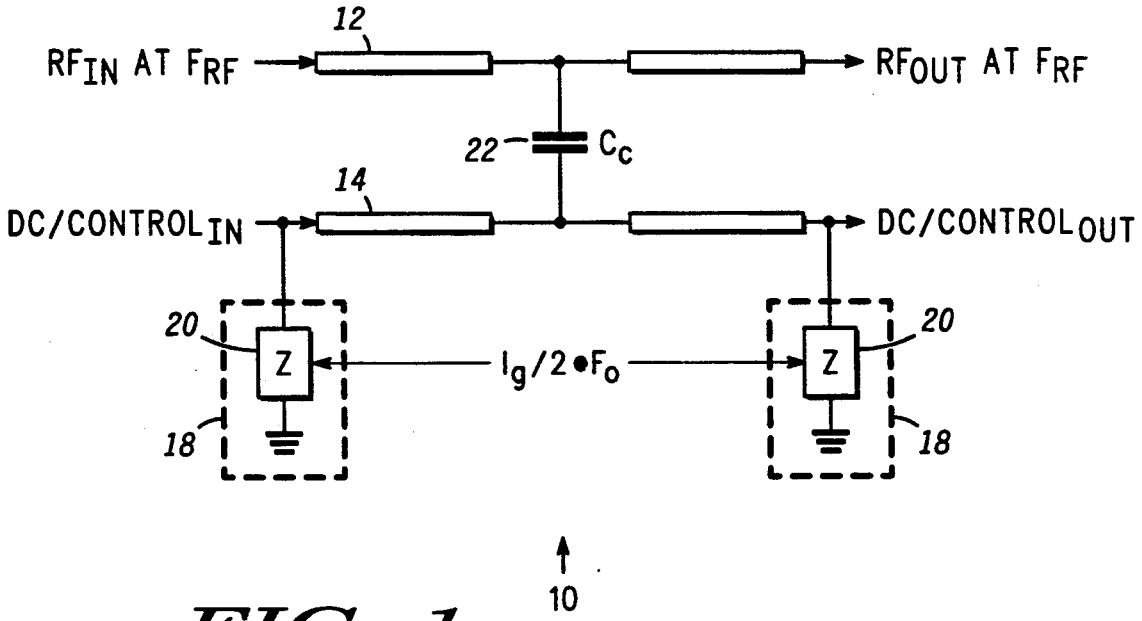
FIG. 1
FIG. 2
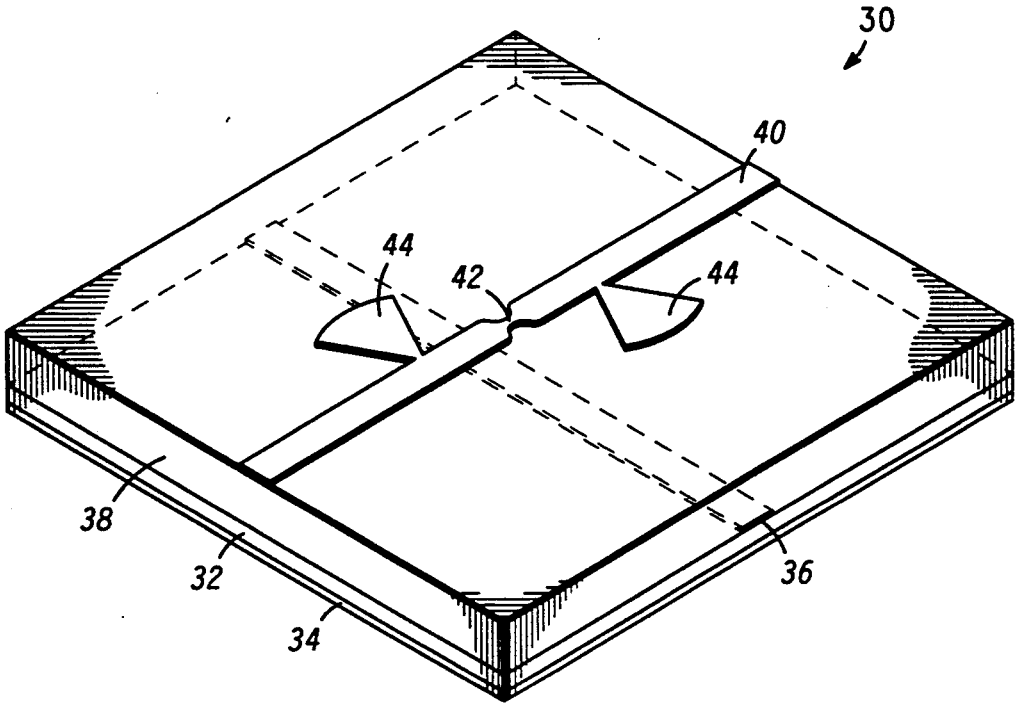

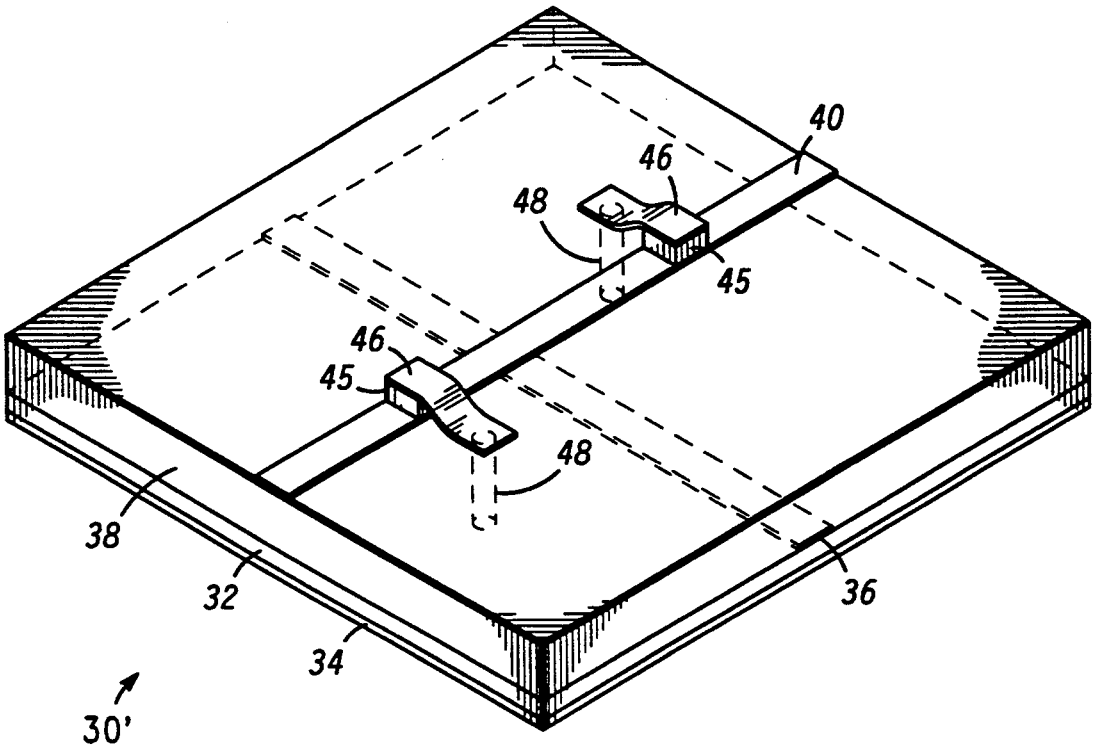
FIG. 3
FIG. 4
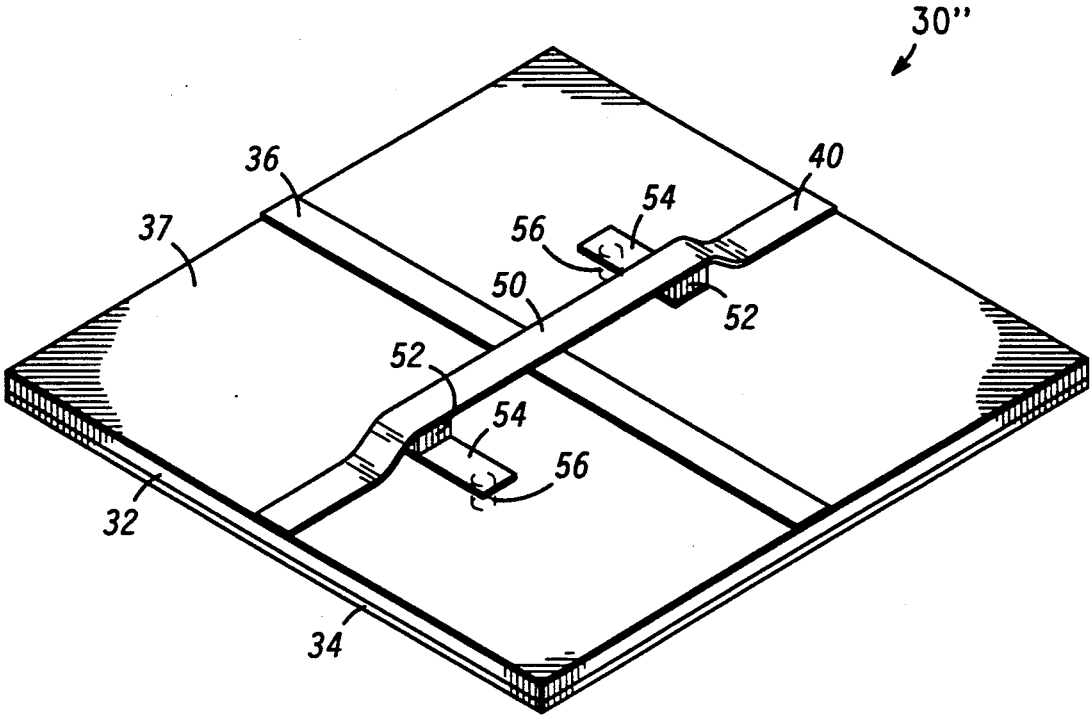

RF CROSSOVER NETWORK

FIELD OF THE INVENTION

This invention relates in general to electromagnetic shielding at crossovers and in particular to isolation between crossing of radio frequency (RF) and direct current control (DC/control) lines.

BACKGROUND OF THE INVENTION

A traditional method for providing shielding between a crossover of a RF line and a DC/control line involves providing the DC/control line as a coaxial cable. The coaxial cable provides the necessary electromagnetic shielding so that an RF signal carried on a RF microstrip line is unperturbed by a DC/control signal on the DC/control line. The use of a coaxial cable for the DC/control line is unfeasible or impractical in a large number of applications, however.

An important application where the use of coaxial cable for the DC/control line is not suitable is in a multilayer board environment. The traditional method for providing isolation between crossing of RF and DC/control lines in such an environment entails using an intermediate ground plane layer in the multilayer board array. The ground plane layer is positioned between the RF and DC layers. This approach, however, requires three metallization layers: one for the RF transmission line metal, one for the ground plane layer, and one for the DC/control line metal. The use of three metalization layers is more costly in terms of material and fabrication than a two-layer design (one layer for the RF line and one layer for the DC/control line).

Thus, what is needed is a practical, economical method for providing isolation between crossing of RF and DC/control traces without the need for bulky and expensive shields or additional metalization layers.

SUMMARY OF THE INVENTION

Accordingly, it is an advantage of the present invention to provide a new and improved apparatus for an RF crossover network providing electromagnetic isolation of an RF line. It is still a further advantage of the present invention to provide apparatus for a RF crossover network which has fewer than three metalization layers and associated reduced material costs.

To achieve these advantages, a RF crossover network is contemplated which includes a RF line or signal trace, a DC/control line or trace capacitively coupled to the RF line at a crossover of the RF line and the DC/control line, and RF terminations coupled to the DC/control line, such that a RF signal at a frequency $F_{RF}$ carried on the RF line is unperturbed by the presence of a DC/control signal on the DC/control line.

The RF line is positioned on a first surface of the first dielectric layer and a second surface of the first dielectric layer comprises a ground plane. A second dielectric layer includes first and second surfaces with the DC/control line mounted on the first surface of the second dielectric layer and the second surface of the second dielectric layer positioned adjacent to the first surface and the RF line of the first dielectric layer.

The RF terminations can comprise shunt capacitors, metal-insulator-metal (MIM) capacitors in a monolithic microwave integrated circuit (MMIC) embodiment, open-circuited quarter wavelength transmission lines, or open circuited radial stubs. The RF terminations are used on opposite ends of a half wave resonator.

The above and other features and advantages of the present invention will be better understood from the following detailed description taken in conjunction with the accompanying drawings.

BRIEF DESCRIPTION OF THE DRAWINGS

In FIG. 1, there is shown a circuit model of a crossover junction of a DC/control line and a RF line, in accordance with a preferred embodiment of the invention.

In FIG. 2, there is shown a half-wave resonator embodiment of a RF crossover network in accordance with a first preferred embodiment of the invention.

In FIG. 3, there is shown a shunt capacitive embodiment of a RF crossover network in accordance with a second preferred embodiment of the invention.

In FIG. 4, there is shown a monolithic microwave integrated circuit (MMIC) metal-insulator-metal (MIM) capacitive embodiment of a RF crossover network in accordance with a third preferred embodiment of the invention.

DETAILED DESCRIPTION OF THE PREFERRED EMBODIMENT

Figure 5:
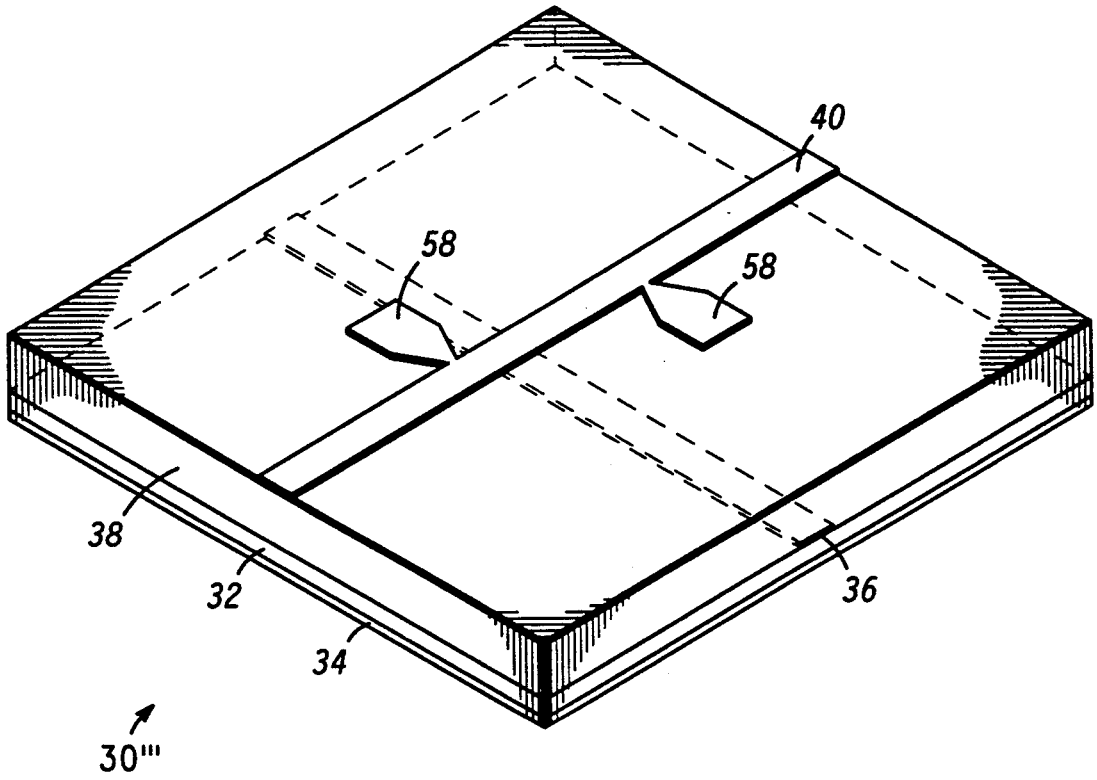
In FIG. 5, there is shown a quarter-wavelength open-circuited stub embodiment of a RF crossover network in accordance with a fourth preferred embodiment of the invention.

In FIG. 1, there is shown a circuit schematic of a modeled junction of a crossover of a DC/control line and a RF line, in accordance with a preferred embodiment of the invention. Crossover network model 10 comprises RF line 12 and DC/control line 14. Coupled between the center of RF line 12 and the center of DC/control line 14 is coupling capacitor 22, of capacitance $C_c$. The coupling capacitor 22 models the capacitive effects of the crossover point of the RF line 12 and the DC/control line 14, and includes the total capacitance (parallel plate plus fringing) represented from the physical proximity of RF line 12 and DC/control line 14. Coupled between each end of the DC/control line 14 and electrical ground are impedances 20, each of impedance Z. The impedances 20 represent RF short circuits with inherent DC blocking characteristics. The combination of impedance 20 and electrical ground coupled to each end of the DC/control line 14 are shown as RF terminations 18 in FIG. 1.

The RF line 12 in FIG. 1 carries a RF signal of frequency $F_{RF}$. The RF input, $RF_{IN}$, is at the left on RF line 12 and the RF output, $RF_{OUT}$, is at the right on RF line 12 in FIG. 1. The DC/control line 14 carries a DC/control signal. The DC/control line input, $DC/control_{IN}$, is at the left on DC/control line 14, and the DC/control line output, $DC/control_{OUT}$, is at the right on DC/control line 14.

The combination of the RF terminations 18 in conjunction with that portion of the DC/control line 14 between the RF terminations 18 comprises a half-wave resonator. The effective length from one RF termination 18 to the other along that portion of the DC/control line 14 between the two RF terminations 18 is one-half the guide wavelength associated with the resonant frequency $F_o$ of the half-wave resonator. That length is shown as $I_g/2$ at $F_o$ in FIG. 1.

In FIG. 1, the RF terminations 18 which provide shunt RF short circuits at the RF frequency are used on the DC/control line 14 on opposite sides of the crossover point at an appropriate distance from the crossover point to cause the central portion of the DC/control line 14 between the RF terminations 18 to act as the half-wave resonator. The RF terminations 18 also provide the additional benefit of isolating the RF line 12 from the uncontrolled impedances seen downstream on the DC/control line 14. This isolation is inherent because any impedance in parallel with a short circuit is still a short circuit. Note that the RF short circuits need only be valid over the RF operating band (values of $F_{RF}$), not at the frequency where the resonator resonates ($F_o$).

A key point necessary for the successful implementation of the model contemplated is that the resonator line section should resonate at a frequency of approximately twice (or more) the frequency resident in the RF line 12. This is necessary because, at the resonant frequency of the resonator, energy passing along the RF path will couple into the resonator resulting in a dip or null in the RF path $S_{21}$. Since it is necessary to keep this null well above the desired RF operating band, the resonator resonant frequency must be well above the RF band.

RF crossover network 30 in FIG. 2 comprises ground plane 34 topped by dielectric layer 32. Microstrip RF line 36 is provided on the top surface of dielectric layer 32 opposite ground plane 34. Dielectric layer 38 tops the upper surface of dielectric layer 32. DC/control line 40 is provided on the upper surface of dielectric layer 38. Dielectric layer 38 is adjacent to the upper surface of dielectric layer 32. DC/control line 40 may have a constriction 42 placed in it at the point at which DC/control line 40 crosses over microstrip RF line 36. DC/control line 40 can be constricted to lessen the coupling capacitance between the microstrip RF line 36 (the signal trace carrying the RF signal) and the DC/control line 40 (the signal trace carrying the DC/control signal). FIG. 2 also comprises radial stubs 44, which are coupled to DC/control line 40 symmetrically about the crossover point on DC/control line 40.

In FIG. 2, dielectric layers 32 and 38 can be comprised of standard dielectric material as is conventionally used in multilayered electronic boards and can be configured in substantially planar parallel layers. The DC/control line 40 and the microstrip RF line 36 will typically be substantially perpendicular at the crossover. The metalization for microstrip RF line 36, DC/control line 40, radial stubs 44 and the ground plane 34 can be conventional conductive material such as copper.

In the FIG. 2 embodiment, the dielectric layer 32 is 0.254 millimeters (0.01 inches) thick and dielectric layer 38 is 0.762 millimeters (0.03 inches) thick. The FIG. 2 embodiment sets the length of the half-wave resonator to 0.254 centimeters (0.1 inches), which corresponds to a resonant frequency of approximately 37 GHz. The RF short circuit terminations are realized as microstrip radial stubs 44 whose lengths are set to approximately 1.778 millimeters (0.07 inches) so that the RF terminations act as good RF short circuits at 20 GHz.

FIG. 3 illustrates a capacitive embodiment of a RF crossover network 30′ in accordance with a second preferred embodiment of the invention. The structure of the FIG. 3 embodiment is identical to that of the FIG. 2 embodiment except for the RF terminations. Reference numerals in FIG. 3 which correspond to reference numerals in FIG. 2 illustrate identical structures, which have been described above. Additionally, FIG. 3 illustrates shunt capacitors 45, straps 46, and back vias 48 to the underside of the ground plane 34. The function of the combination of capacitors 45, straps 46, and back vias 48 is to provide RF short circuit terminations on DC/control lines 40 to isolate any RF signal on microstrip RF line 36 from the DC/control line 40. The shunt capacitors 45 operate in a self-resonance condition to provide such isolation or non-perturbation.

DC/control line 40 in FIG. 3 may have a constriction placed in it at the point at which DC/control line 40 crosses over microstrip RF line 36 as was shown in FIG. 2, if desired. Also, in FIG. 3, dielectric layers 32 and 38 can be comprised of standard dielectric material as is conventionally used in multilayered electronic boards and can be configured in substantially planar parallel layers. The DC/control line 40 and the microstrip RF line 36 will typically be substantially perpendicular at the crossover. The metalization for microstrip RF line 36, DC/control line 40, the ground plane 34, straps 46, and back vias 48 can be conventional conductive material such as copper.

In FIG. 4, there is shown a monolithic microwave integrated circuit (MMIC) embodiment of a RF crossover network in accordance with a third preferred embodiment of the invention. The structure of the FIG. 4 embodiment is similar to that of the FIG. 2 embodiment except for the RF terminations and the MMIC structure. FIG. 4 illustrates RF crossover network 30″, including ground plane 34 underneath dielectric layer 32. Microstrip RF line 36 is provided on dielectric layer 32. DC/control line 40 crosses over microstrip RF line 36 via an air bridge 50. The portion of DC/control line 40 which crosses microstrip RF line 36 is elevated above the top surface 37 of dielectric layer 32 and microstrip RF line 36 by metal-insulator-metal (MIM) capacitors 52 coupled to the top surface 37 of dielectric layer 32. Additionally, pad extensions 54 and back vias 56 to the underside of the ground plane 34 are shown in FIG. 4.

The MIM capacitors 52 in FIG. 4 are coupled through the pad extensions 54 and back vias 56 to electrical ground (the ground plane 34). The function of the combination of MIM capacitors 52, pad extensions 54, and back vias 56 is to provide the RF short circuit terminations on DC/control lines 40 to isolate any RF signal on microstrip RF line 36 from any perturbation arising from the DC/control line 40.

DC/control line 40 in FIG. 4 may have a constriction placed in it at the point at which DC/control line 40 crosses over microstrip RF line 36 as was shown in FIG. 2, if desired. Also, in FIG. 4, dielectric layer 32 can be comprised of standard dielectric material as is conventionally used in MMICs. The DC/control line 40 and the microstrip RF line 36 will typically be substantially perpendicular at the crossover. The metalization for microstrip RF line 36, DC/control line 40, the ground plane 34, pad extensions 54, and back vias 56 can be conventional conductive material such as gold.

In FIG. 5, there is shown a quarter-wavelength open-circuited stub embodiment of a RF crossover network 30‴ in accordance with a fourth preferred embodiment of the invention. The structure of the FIG. 5 embodiment is identical to that of the FIG. 2 embodiment except for the RF terminations. Reference numerals in FIG. 5 which correspond to reference numerals in FIG. 2 illustrate identical structures, which have been described above. In the FIG. 5 embodiment, however, stubs 58 represent open circuited quarter-wavelength transmission lines at guide frequency $F_{RF}$. The function of the stubs 58 is to provide the RF short circuit terminations on DC/control line 40 to isolate any RF signal on microstrip RF line 36 from any perturbation arising from the DC/control line 40.

DC/control line 40 in FIG. 5 may have a constriction placed in it at the point at which DC/control line 40 crosses over microstrip RF line 36 as was shown in FIG. 2, if desired. Also, in FIG. 5, dielectric layers 32 and 38 can be comprised of standard dielectric material as is conventionally used in multilayered electronic boards and can be configured in substantially planar parallel layers. The DC/control line 40 and the microstrip RF line 36 will typically be substantially perpendicular at the crossover. The metalization for microstrip RF line 36, DC/control line 40, the ground plane 34, and one-quarter wavelength stubs 58 can be conventional conductive material such as copper.

Thus, a RF crossover network has been described which overcomes specific problems and accomplishes certain advantages relative to prior art methods and mechanisms. The improvements over known technology are significant. Traditional shielding is not required. The expense, complexities, and higher costs of three or greater metalization layers are avoided.

Thus, there has also been provided, in accordance with an embodiment of the invention, a RF crossover network that fully satisfies the aims and advantages set forth above. While the invention has been described in conjunction with a specific embodiment, many alternatives, modifications, and variations will be apparent to those of ordinary skill in the art in light of the foregoing description. Accordingly, the invention is intended to embrace all such alternatives, modifications, and variations as fall within the spirit and broad scope of the appended claims.

I claim:

1. A RF crossover network comprising:

a RF line;

a first dielectric layer comprising a first surface and a second surface, wherein the RF line is mounted on the first surface of the first dielectric layer;

a ground plane adjacent to the second surface of the first dielectric layer;

a DC/control line capacitively coupled to the RF line at a crossover of the RF line and the DC/control line;

a second dielectric layer, with first and second surfaces, wherein the DC/control line is mounted on the first surface of the second dielectric layer and the second surface of the second dielectric layer is positioned adjacent to the first surface of the first dielectric layer; and a plurality of RF termination means coupled to the DC/control line, such that a RF signal at a frequency $F_{RF}$ carried on the RF line is electromagnetically isolated from a DC/control signal on the DC/control line wherein the RF crossover network is a monolithic microwave integrated circuit and the plurality of RF termination means comprises a plurality of metal-insulator-metal (MIM) capacitors.

2. A RF crossover network as claimed in claim 1, wherein the DC/control line air bridges the RF line.

3. A RF crossover network comprising:

a RF line;

a first dielectric layer comprising a first surface and a second surface, wherein the RF line is mounted on the first surface of the first dielectric layer;

a ground plane adjacent to the second surface of the first dielectric layer;

a DC/control line capacitively coupled to the RF line at a crossover of the RF line and the DC/control line;

a second dielectric layer, with first and second surfaces, wherein the DC/control line is mounted on the first surface of the second dielectric layer and the second surface of the second dielectric layer is positioned adjacent to the first surface of the first dielectric layer; and a plurality of RF termination means coupled to the DC/control line, such that a RF signal at a frequency $F_{RF}$ carried on the RF line is electromagnetically isolated from a DC/control signal of the DC/control line wherein the plurality of RF termination means comprises a plurality of open-circuited transmission lines, wherein each transmission line is one-quarter guide wavelength in length at the frequency $F_{RF}$.

4. A RF crossover network as claimed in claim 3, wherein each transmission line is positioned one-half of the guide wavelength apart and the guide wavelength is determined at a resonant frequency greater than approximately twice the frequency $F_{RF}$.

5. A RF crossover network comprising:

a RF line;

a first dielectric layer comprising a first surface and a second surface, wherein the RF line is mounted on the first surface of the first dielectric layer;

a ground plane adjacent to the second surface of the first dielectric layer;

a DC/control line capacitively coupled to the RF line at a crossover of the RF line and the DC/control line;

a second dielectric layer, with first and second surfaces, wherein the DC/control line is mounted on the first surface of the second dielectric layer and the second surface of the second dielectric layer is positioned adjacent to the first surface of the first dielectric layer; and a plurality of RF termination means coupled to the DC/control line, such that a RF signal at a frequency $F_{RF}$ carried on the RF line is electromagnetically isolated from a DC/control signal on the DC/control line, the plurality of RF termination means comprising first and second radial stubs positioned one-half of a guide wavelength apart, wherein the guide wavelength is determined at a resonant frequency greater than approximately twice the frequency $F_{RF}$.

6. A RF crossover as claimed in claim 5, wherein the first and second surfaces of the first dielectric layer and the first and second surfaces of the second dielectric layer are substantially planar and substantially parallel to one another.

7. A RF crossover network as claimed in claim 6, wherein the DC/control line and the RF line are substantially perpendicular at the crossover.

* * * * *